US005492345A

United States Patent [19]

Kruczek

[11] Patent Number: 5,492,345

[45] Date of Patent: Feb. 20, 1996

[54] SELF PROPELLED ROLLER SKATE

[76] Inventor: Leszek Kruczek, 48 Driggs Ave., Apt. 2L, Brooklyn, N.Y. 11222

[21] Appl. No.: 296,037

[22] Filed: Aug. 25, 1994

[51] Int. Cl.[6] ..... A63C 17/14; A63C 17/08; A63C 17/12

[52] U.S. Cl. ..... 280/11.115; 280/11.2

[58] Field of Search ..... 280/11.115, 11.23, 280/11.21, 11.25, 11.2, 251

[56] References Cited

U.S. PATENT DOCUMENTS

| | | | |
|---|---|---|---|
| 619,370 | 2/1899 | Wagner | 280/11.115 |
| 3,039,790 | 6/1962 | Trott | 280/251 |
| 3,285,618 | 11/1966 | Welch | 280/11.115 |
| 4,417,737 | 11/1983 | Suroff | 280/11.115 |
| 4,445,698 | 5/1984 | Stillwell | 280/11.115 |
| 4,602,801 | 7/1986 | Vincent | 280/11.115 |
| 4,696,485 | 9/1987 | Lee | 280/11.115 |
| 4,706,974 | 11/1987 | Vincent | 280/11.115 |
| 5,056,802 | 10/1991 | Piotrowski | 280/11.115 |

FOREIGN PATENT DOCUMENTS

| | | | |
|---|---|---|---|
| 2726961 | 1/1979 | Germany | 280/11.2 |
| 278004 | 9/1930 | Italy | 280/11.23 |

*Primary Examiner*—Karin L. Tyson

[57] ABSTRACT

Spaced frame rails mount a U-shaped frame therebetween, wherein the U-shaped frame is pivotally mounted relative to a first axle mounting a first wheel at a first end of the side rails, with a second axle mounted at the second end of the side rails supporting a second wheel. The side rails include extension legs extending from the side rails mounting a spool axle, with the spool axle mounting a first spool wheel that is mechanically coupled to the U-shaped support frame by means of a first string, with a second string directed from a second spool wheel on the spool axle to a third spool wheel mounted to the second axle, that in turn includes a ratchet and pawl structure, whereupon pivoting of the U-shaped frame rotates the first and second spool wheels as well as the third spool wheel to effect rotation of the ratchet and second axle effecting propulsion of the roller skate structure.

6 Claims, 5 Drawing Sheets

SELF PROPELLED ROLLER SKATE

BACKGROUND OF THE INVENTION

1. Field of the Invention

The field of invention relates to roller skate apparatus, and more particularly pertains to a new self propelled roller skate wherein the same is directed to the self propulsion roller skate of the invention.

2. Description of the Prior Art

Self propelled roller skates of various types are indicated in the prior art such as in U.S. Pat. Nos. 5,056,802; 4,445,698; 4,706,974; 4,602,801; and 4,417,737.

The instant invention sets forth a novel roller skate structure wherein the same is directed to the use of cooperative spool wheels to effect rotation of a drive wheel and in this respect, the present invention substantially fulfills this need.

SUMMARY OF THE INVENTION

In view of the disadvantages inherent in the known types of self propelled roller skates now present in the prior art, the present invention provides a self propelled roller skate wherein the same includes a pivot framework supported within spaced rail structure to effect the driving of a rear wheel of the roller skate structure.

To attain this, the present invention provides spaced frame rails which mount a U-shaped frame therebetween, wherein the U-shaped frame is pivotally mounted relative to a first axle mounting a first wheel at a first end of the side rails, with a second axle mounted at the second end of the side rails supporting a second wheel. The side rails include extension legs extending from the side rails mounting a spool axle, with the spool axle mounting a first spool wheel that is mechanically coupled to the U-shaped support frame by means of a first string, with a second string directed from a second spool wheel on the spool axle to a third spool wheel mounted to the second axle, that in turn includes a ratchet and pawl structure, whereupon pivoting of the U-shaped frame rotates the first and second spool wheels as well as the third spool wheel to effect rotation of the ratchet and second axle effecting propulsion of the roller skate structure.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is an object of the present invention to provide a new self propelled roller skate which may be easily and efficiently manufactured and marketed.

It is a further object of the present invention to provide a new self propelled roller skate which is of a durable and reliable construction.

An even further object of the present invention is to provide a new self propelled roller skate which is susceptible of a low cost of manufacture with regard to both materials and labor, and which accordingly is then susceptible of low prices of sale to the consuming public, thereby making such self propelled roller skates economically available to the buying public.

Still yet another object of the present invention is to provide a new self propelled roller skate which provides in the apparatuses and methods of the prior art some of the advantages thereof, while simultaneously overcoming some of the disadvantages normally associated therewith.

Yet an even further object of the present invention is to provide a new self propelled roller skate having pivotal means coupled to a wheel assembly thereof whereby depression of the pivotal means is effective to cause rotation of the wheels carried by the wheel assembly and propulsion of the roller skate structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
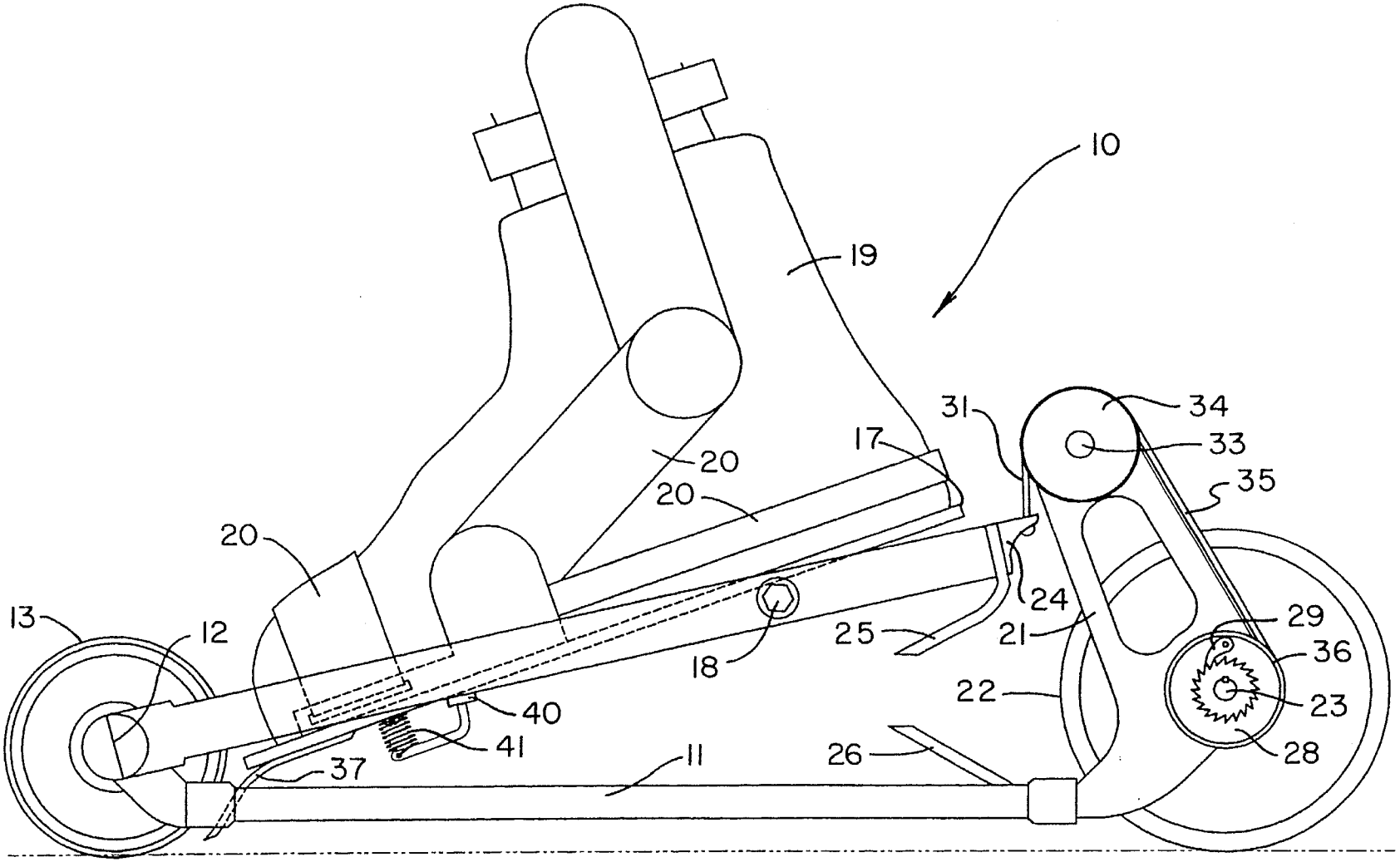
FIG. 1 is an orthographic side view of the invention.

With reference now to the drawings, and in particular to FIGS. 1–6 thereof, a new self propelled roller skate embodying the principles and concepts of the present invention and generally designated by the reference numeral 10 will be described.

More specifically, the self propelled roller skate 10 of the instant invention comprises spaced frame side rails 11 mounting a first axle 12 at a first end 11*a* of the side rails, with a first wheel 13 being rotatably mounted about the first axle. Similarly, a second wheel 22 is rotatably mounted about a second axle 23 at a second end 11*b* of the frame side rails 11, such that the first and second axles 12 and 22 are arranged in a parallel relationship relative to one another.

Figure 2:
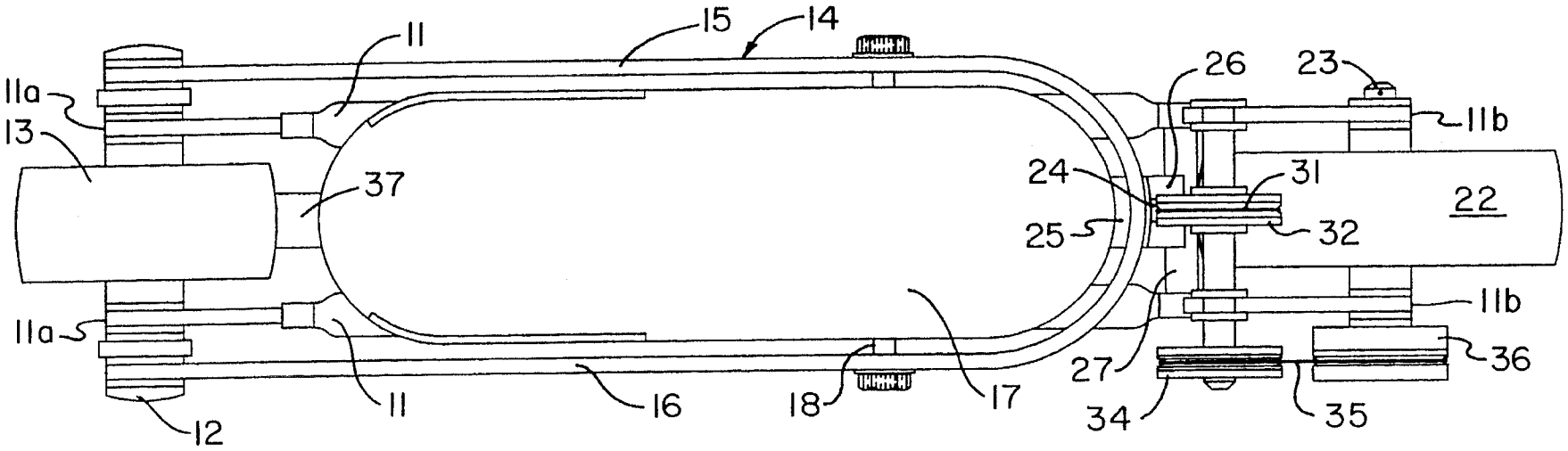
FIG. 2 is an orthographic top view of the invention.
Figure 3:
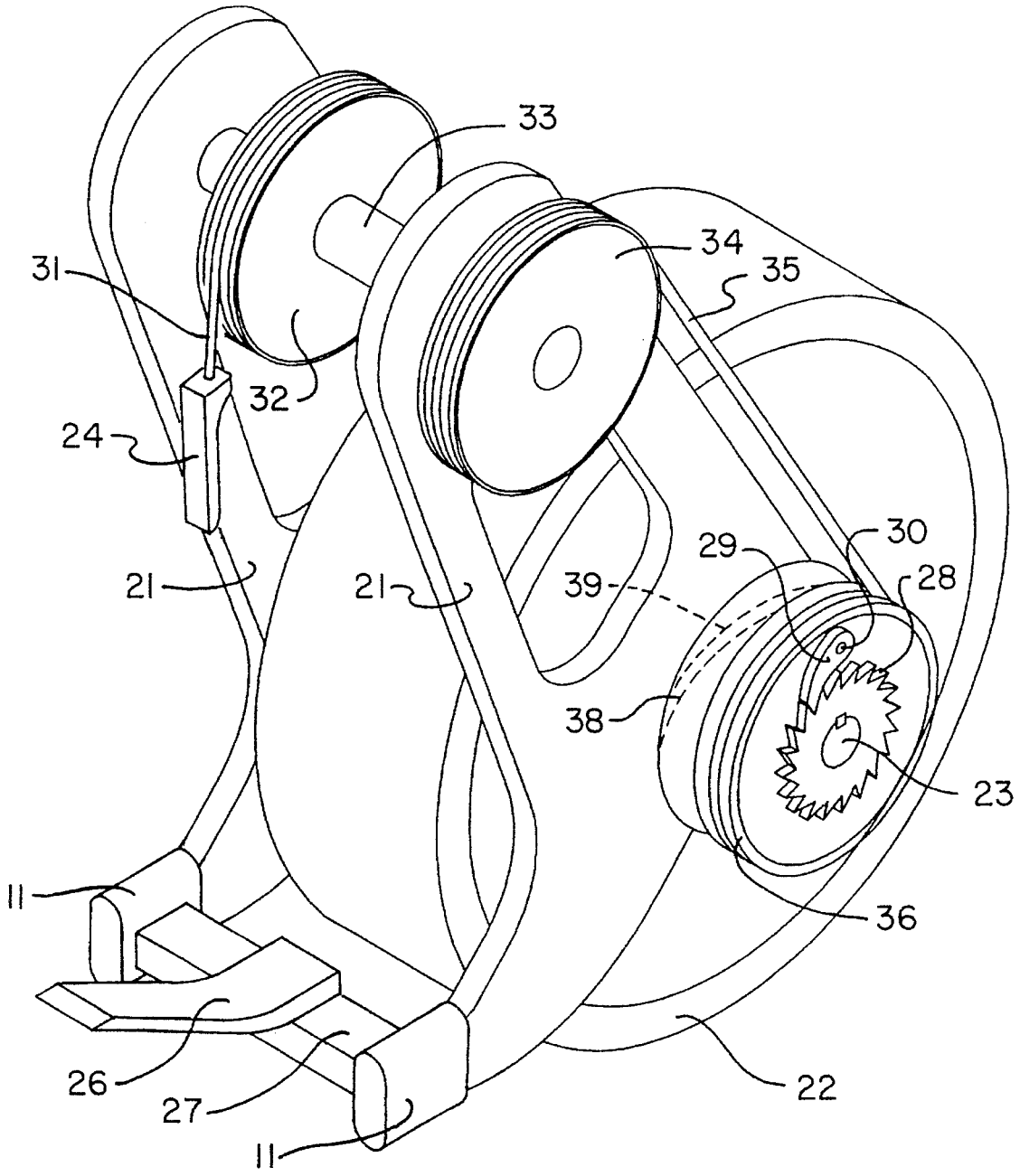
FIG. 3 is an isometric partial view of the rear wheel structure.
Figure 4:
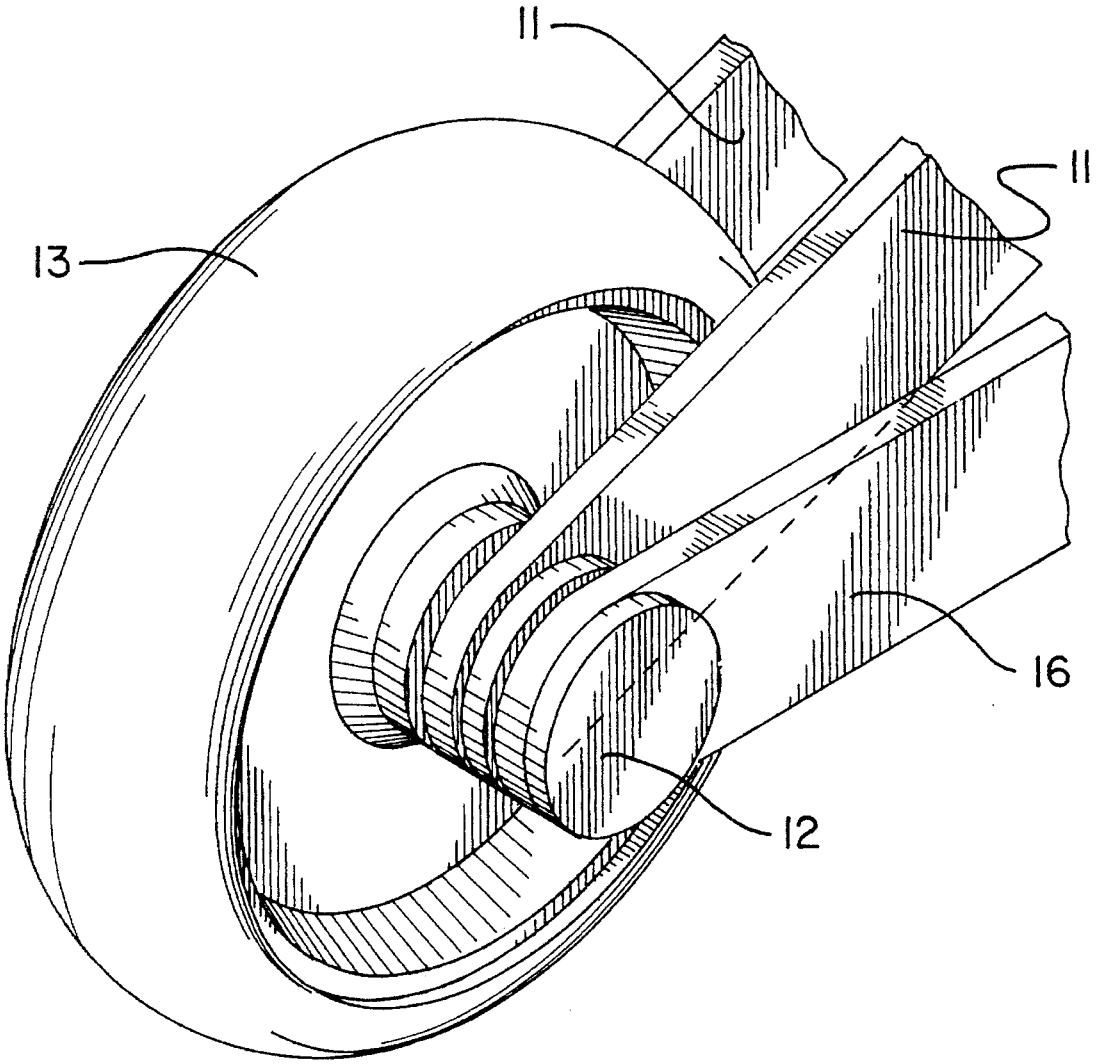
FIG. 4 is an isometric view of the forward wheel

As best shown in the plan view of FIG. 2, a U-shaped support frame 14 having first and second legs 15 and 16 is oriented between the spaced frame side rails 11, with the first and second legs 15 and 16 pivotally mounted to the first axle at the forward ends of the first and second legs. A pedal plate 17 is mounted about a pedal plate axle 18 within the U-shaped support frame 14, with a boot member 19 being optionally provided and having securement straps 20 secured to the pedal plate 17 to secure an individual's foot to the boot member and accordingly to the pedal plate 17.

To transfer a pivoting motion of the pedal plate 17 to the second wheel 22, a pair of extension legs 21 are provided and extend from the second end 11*b* of the respective frame rails 11 at an oblique angle relative thereto to a point above the second wheel. An actuator plate 24 is fixed to the a rear distal end of the U-shaped support frame 14 and includes a first spring leg 25 arranged to engage the second spring leg 26 mounted to a cross bar 27 between the side rails 11 adjacent the second axle 23, such that the first spring leg cooperates with the second spring leg to dampen impact and limit pivoting of the U-shaped frame 14. A toothed ratchet wheel 28 is secured to an outermost end of the second axle 23 and a ratchet pawl 29 cooperative therewith is secured to a third spool wheel 36 by a pawl pivot pin 30, with a suitable spring being interposed between the pawl and the third spool wheel to bias the pawl into engagement with the ratchet wheel at all times. A second spool wheel 34 is mounted laterally of one of the extension legs to a spool axle 33 extending between a distal end of the extension legs 21, with a first spool wheel mounted between the extension legs onto the same spool axle 33. A first string 31 formed of a resilient construction extends from the first spool wheel 32 to the actuator plate 24, whereupon downward pressure applied to the U-shaped frame 14 by an individual rotates the first and second spool wheels 32 and 34, thereby drawing a second string 35 wound from the third spool wheel 36 onto the second spool wheel 34 to effect rotation of the second axle by an engagement of the ratchet pawl 29 to the toothed ratchet wheel 28.

A spring housing 38 is mounted to the third spool wheel 36, such that a spring 39 secured to the spring housing 38 and to one of the side rails 11 effects clockwise rotation of the third spool wheel about the ratchet wheel 28 and the second axle 23 as a result of the third spool wheel 36 being rotatably mounted about the second axle 23 and engaged to the side rail by the spring construction 39. Thusly, the spring 39 biases the third spool wheel 36 to clockwise rotation from a counter-clockwise rotation effected by drawing the second string 35 from the third spool wheel 36, wherein clockwise rotation of the third spool wheel thereby rewinds the third string 35 about the third spool wheel. Further, the first string 31 may therefore be provided of a non-resilient construction, but merely a flexible construction if desired, as the mere force of the spring 39 may thereby effect the return and lifting of the U-shaped frame 14 to the raised position, as illustrated in FIG. 1, from a lowered position that initially projects the first string 31 downwardly towards the side rails 11.

To maintain the pedal plate 17 in a desired orientation, a support beam 40 extends between the first and second legs 15 and 16, such that a spring 41 mounted to the pedal 17 is biased towards the beam 40. In this manner, stability of the pedal 17 is imparted to help maintain balance while employing the device 10 and further prevents an undesired downward tilting of the pedal 17 to an extreme to permit the brake 37 to normally contact an underlying support surface such as a pavement or roadway, unless so desired. In this manner, the pedal plate 17 may pivot so as to engage the brake member 37 against a ground surface to effect deceleration of the skate 10.

Figure 6:
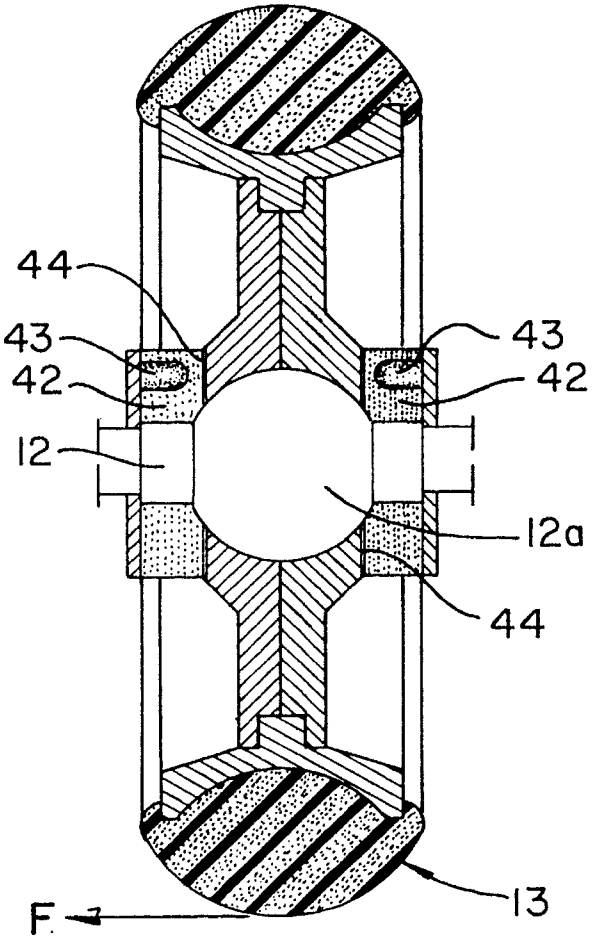
FIG. 6 is an orthographic view, taken along the lines 6—6 of FIG. 5 in the direction indicated by the arrows.
Figure 5:
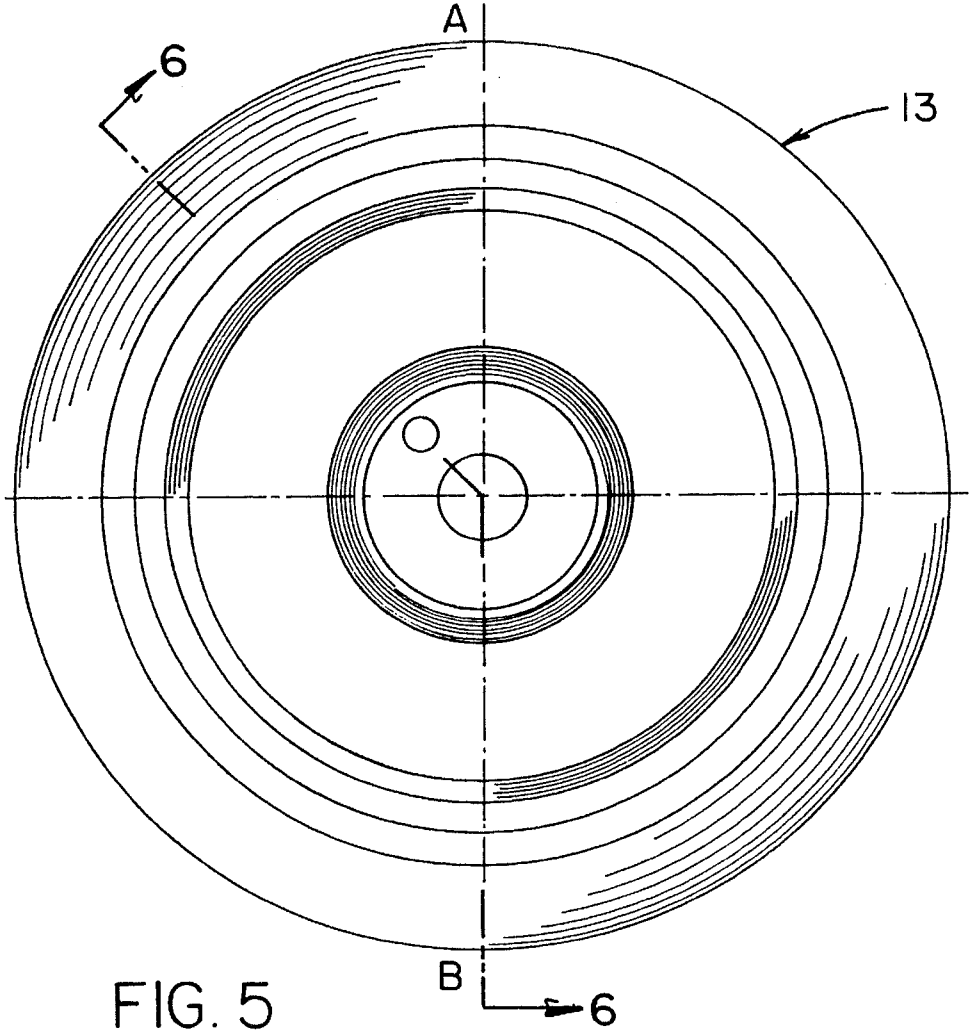
FIG. 5 is an orthographic side view of the forward wheel of the organization.

Reference to FIG. 5 indicates the front wheel 13 and the manner in which steering of the device is made possible. The front wheel 13 rotates around the axle 12 about a spherical portion 12*a*, as illustrated in FIG. 6, with the axle 12 remaining stationary. Sliding washers 44 and rubber ring washers 42 are attached to the wheel 13 at opposed sides of the spherical portion 12*a*, with the sliding washers 44 and rubber ring washers 42 being motionless and secured relative to one another. The rubber ring washers 42 are made of a resilient rubber material and contain at least one insert 43 formed of further rubber of less resilience relative to the ring washers. Thusly, in making a turn, an individual's foot may tilt in a similar manner to skiing or ice skating, such that a force "F" acting upon the wheel 13 when tilted effects the wheel to shift relative to its horizontal plane. Positioning the harder rubber inserts 43 laterally and exteriorly of the A-B axis at a top portion of the rubber ring 42, together with the action of the aforenoted force, causes the wheel to turn relative to its horizontal plane providing for ease in utilization of the organization 10.

As to the manner of usage and operation of the instant invention, the same should be apparent from the above disclosure, and accordingly no further discussion relative to the manner of usage and operation of the instant invention shall be provided.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the Abstract provided at the beginning of this specification is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A self propelled roller skate comprising:

a pair of spaced frame side rails having a first end spaced from a second end;

a first axle rotatably mounted to said first end of said side rails and positioned between said side rails;

a second axle rotatably mounted to said second end of said side rails and positioned between said side rails, wherein said first axle and said second axle are arranged in a parallel relationship relative to one another;

a first wheel rotatably mounted about said first axle and between said side rails; a second wheel rotatably mounted about said second axle and between said side rails;

a U-shaped frame having a first leg spaced from a second leg, with said first leg and said second leg pivotally mounted about said first axle; a pedal plate axle directed orthogonally between said first leg and second leg; a pedal plate pivotally mounted about said pedal plate axle;

a pair of extension legs each mounted to an individual one of said side rails and oriented at an oblique angle relative to said each frame side rail; a spool axle directed between said extension legs;

a first spool wheel mounted between said extension legs about said spool axle; a second spool wheel mounted to said spool axle laterally adjacent one of said extension legs; a third spool wheel having a spring housing and being rotatably mounted about said second axle; a spring mounted within said spring housing and coupled to both said spring housing and one of said side rails;

a ratchet wheel mounted to said second axle with a pawl mounted to said third spool wheel in engagement with said ratchet wheel;

a first drive string extending from said U-shaped frame to said first spool wheel, and a second drive string directed between said second spool wheel and said third spool wheel, whereby a downward pivoting of said pedal plate effects rotation of said second wheel to propel said skate forward.

2. A roller skate as set forth in claim 1 wherein said U-shaped support frame includes an actuator plate having said first drive string secured thereto, and said actuator plate includes a first spring leg, and a cross bar extending between said frame side rails, said cross bar having a second spring leg mounted thereto arranged in facing relationship relative to said first spring leg to permit engagement of said first spring leg with said second spring leg upon pivoting of said U-shaped frame relative to said frame side rails.

3. A roller skate as set forth in claim 2, wherein said pedal plate includes a brake flange mounted to a forwardmost end of said pedal plate adjacent said first wheel, whereupon pivoting of said pedal plate about said pedal plate axle permits engagement of said brake flange with an underlying support surface to effect deceleration of said skate.

4. A roller skate as set forth in claim 3, wherein said first axle includes a central spherical portion, with said first wheel being mounted about said spherical portion, with said first wheel having opposed sides, and each of said opposed sides including a sliding washer mounted to said first wheel, with each said sliding washers having a resilient ring washer mounted thereto, with each ring washer including a polymeric insert disposed therewithin, wherein each said polymeric inserts is of a first resiliency, and said ring washer is of a second resiliency less than said first resiliency.

5. A self propelled roller skate comprising:

a pair of spaced frame side rails having a first end spaced from a second end;

a first axle rotatably mounted to said first end of said side rails and positioned between said side end a first wheel rotatably mounted to said first axle and between said side rails; a second wheel rotatably mounted to said second end of said frame side rails and between said side rails;

a U-shaped frame having a first leg spaced from a second leg, with said first leg and said second leg pivotally mounted about said first axle; a pedal plate axle directed orthogonally between said first leg and second leg; a pedal plate pivotally mounted about said pedal plate axle; and, means responsive to a pivoting of said U-shaped frame relative to said side rails for rotating said second wheel, thereby propelling said skate.

6. A roller skate as set forth in claim 5, wherein said means responsive to a pivoting of said U-shaped frame relative to said side rails for rotating said second wheel comprises:

a second axle rotatably mounted to said second end of said side rails and positioned between said side rails, with said second wheel being rotatably mounted about said second axle and between said side rails, said second axle supporting said second wheel;

a pair of extension legs each mounted to an individual one of said side rails and oriented at an oblique angle relative to said each frame side rail; a spool axle directed between said extension legs;

a first spool wheel mounted between said extension legs about said spool axle;

a second spool wheel mounted to said spool axle laterally adjacent one of said extension legs;

a third spool wheel having a spring housing and being rotatably mounted about said second axle;

a spring mounted within said spring housing and coupled to both said spring housing and one of said side rails;

a ratchet wheel mounted to said second axle with a pawl mounted to said third spool wheel in engagement with said ratchet wheel;

a first drive string extending from said U-shaped frame to said first spool wheel, and a second drive string directed between said second spool wheel and said third spool wheel, whereby a downward pivoting of said pedal plate effects rotation of said second wheel to propel said skate forward.

* * * * *